United States Patent [19]

Banys

[11] Patent Number: 4,700,755

[45] Date of Patent: Oct. 20, 1987

[54] MESH BAG OPENER AND BAG FILLING SYSTEM

[75] Inventor: Algis R. Banys, Reno, Nev.

[73] Assignee: Filper Corporation, Reno, Nev.

[21] Appl. No.: 814,856

[22] Filed: Dec. 30, 1985

[51] Int. Cl.[4] ..... B65B 1/00

[52] U.S. Cl. ..... 141/114; 248/100

[58] Field of Search ..... 53/384, 468, 573; 248/95, 100; 141/10, 68, 114, 166, 313, 314, 317

[56] References Cited

U.S. PATENT DOCUMENTS

| | | | |
|---|---|---|---|
| 2,995,329 | 8/1961 | Talcott, Jr. | 248/100 X |
| 3,719,022 | 3/1973 | Cherio et al. | 53/255 |
| 3,732,662 | 5/1973 | Paxton | 53/415 |
| 3,750,721 | 8/1973 | Hudson | 141/114 X |
| 3,789,570 | 2/1974 | Mullins, Jr. | 53/459 |
| 3,903,677 | 9/1975 | Bowman et al. | 53/384 |
| 4,091,595 | 5/1978 | Pelster et al. | 53/417 |
| 4,172,349 | 10/1979 | Lipes | 53/459 |

FOREIGN PATENT DOCUMENTS 2256248 11/1972 Fed. Rep. of Germany ..... 53/384

*Primary Examiner*—Charles E. Phillips
*Assistant Examiner*—Mark J. Thronson
*Attorney, Agent, or Firm*—Townsend & Townsend

[57] ABSTRACT

A bag opening apparatus comprises a pair of pivotable pins mounted on a movable carriage. The carriage is mounted on the rod of the first piston and cylinder assembly so that is may move in and out of proximity with a stack of mesh bags to be opened and filled. The mesh bags are supported on one face only so that the opposed face may be opened by inserting the pins into the bag and moving the pins outward to engage the mesh faces. Only the face which is not suspended will be opened as the pins are drawn away on the movable carriage. A second piston and cylinder assembly includes a stop pumper which is located to control the extent that the carriage is retracted and to thereby control the extent of the bag opening.

11 Claims, 8 Drawing Figures

MESH BAG OPENER AND BAG FILLING SYSTEM

BACKGROUND OF THE INVENTION

This invention relates generally to systems and methods for automatically filling bags, and more particularly to systems and methods for opening and filling mesh bags.

Systems for automatically bagging fresh fruits and vegetables are well-known. A typical system might include a mechanism for holding a supply of empty bags, a mechanism for individually opening the bags and supporting them while they are being filled, and a mechanism for directing a preweighed amount of produce into the bag. These mechanisms may be arranged in a variety of ways, but each mechanism will usually be found in an automatic bagging system. After filling, the individual bags are sealed and transported away for storage or shipment.

The major difficulty with automatic bagging systems has been the manipulation of individual bags, particularly the operation of opening the individual bags and suspending them prior to filling. Heretofore, mechanisms for opening the individual bags have typically employed vacuum or suction cups for attaching to one face of the bag and pulling it away from the opposed face. Such systems, although generally workable, are not always completely reliable, particularly when handling mesh bags which resist adherence by vacuum-assisted grasping means. It would therefore be desirable to provide alternate mechanisms for opening bags in automatic bagging systems and elsewhere. It would be particularly desirable to provide such bag opening systems which will function reliably with mesh bags.

SUMMARY OF THE INVENTION

The present invention provides a simple yet reliable apparatus for opening mesh bags, typically as a part of an automatic bag filling system. The apparatus relies on a pair of spaced-part pivotable pins to penetrate the bag and to draw one face of the bag away from the opposed face. The pivotable pins are mounted on a movable carriage which may be brought adjacent to a stack of vertically suspended mesh bags. The pins are initially oriented perpendicularly to the bags so that they will penetrate into the stack a distance equal to or slightly greater than one-half the thickness of a bag. The pins are then pivoted away from one another so that they engage the mesh in the outermost face of the end bag. The bags are suspended by one face only, so that the exposed face which is not suspended is drawn back as the carriage is retracted. A mechanism is provided to stop travel of the carriage at a particular location corresponding to the desired bag opening. Once the bag is opened to that extent, a conventional mechanism for holding the bag is inserted into the bag, the bag removed from the bag supply. The pins are then released from the bag, and the carriage retracted the remainder of the distance. The bag may then be filled by conventional filling mechanisms.

In the preferred embodiment, the carriage is mounted on a first piston and cylinder assembly which provides for its travel between the retracted and fully extended positions. A second piston and cylinder assembly is provided for defining the intermediate stop point for the carriage as it is retracted. The second cylinder assembly is aligned parallel to the first piston cylinder assembly and is extended a preselected distance to define an appropriate stop print. A third piston and cylinder assembly is mounted on the carriage and provides for rotation of the pivotable pins through a linkage assembly.

The remainder of the automatic bag filling system may be conventional. Usually, the bag filling apparatus will include a plurality of support arms which are introduced into the bag and drawn apart to engage the bag at various points around its circumference. In this manner, the bag is held open and supported by the support arms. The bag is then filled through a filling chute which directs the produce through the opening defined by the four support arms.

DESCRIPTION OF THE PREFERRED EMBODIMENTS

Figure 1:
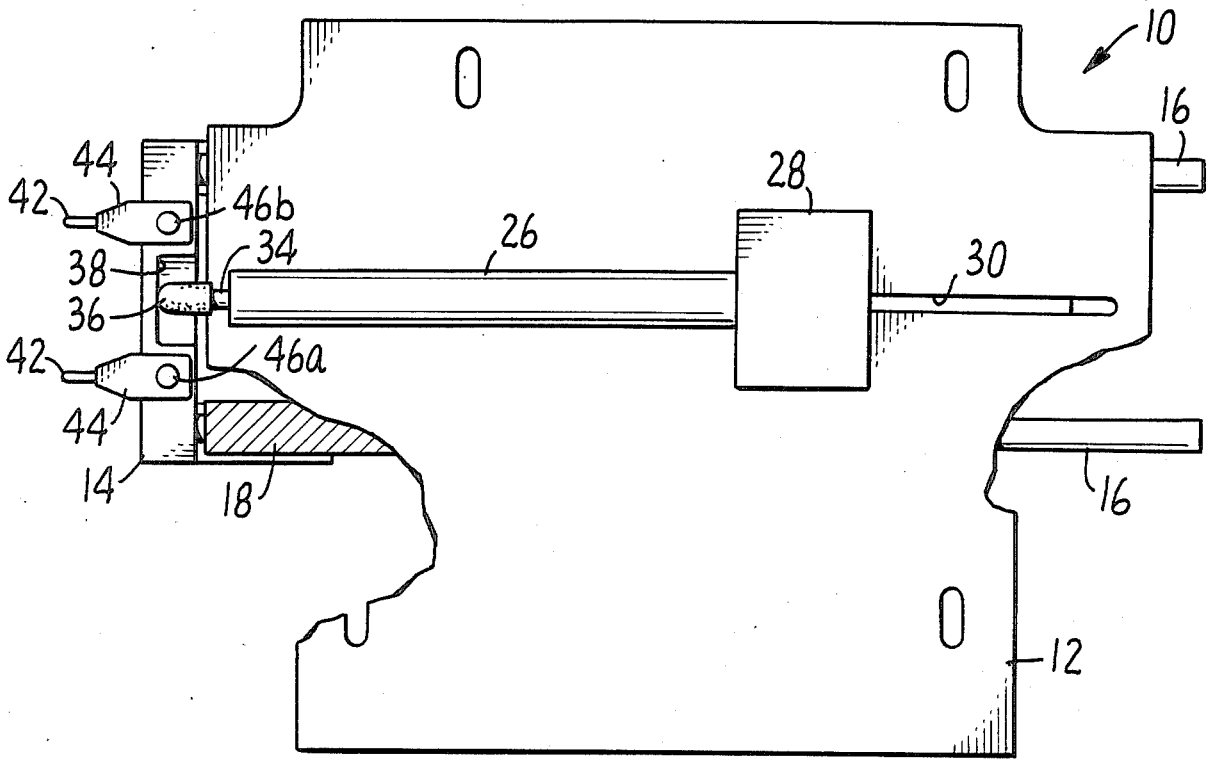
FIG. 1 is a top plan view of the bag opening apparatus of the present invention with portions broken away.
Figure 2:
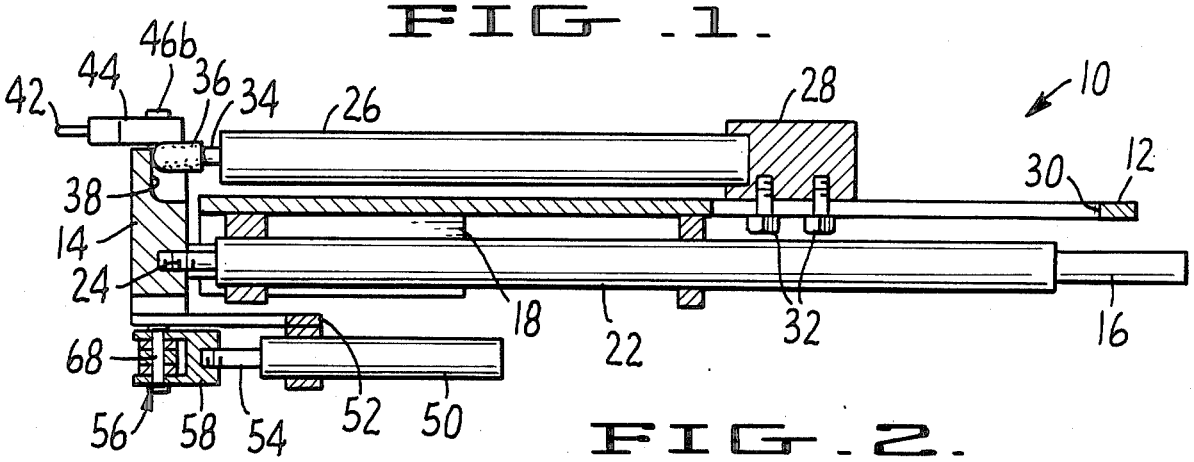
FIG. 2 is a side elevational view of the bag opening apparatus of the present invention shown in cross section.
Figure 3:
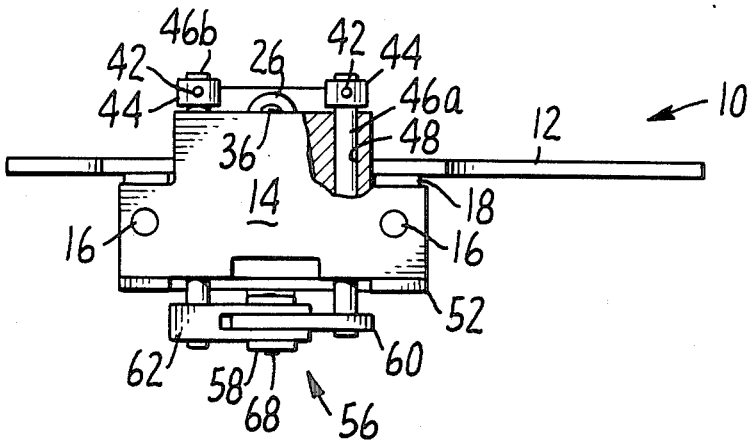
FIG. 3 is a front elevational view of the bag opening apparatus of the present invention with portions broken away.

Referring to FIGS. 1–3, a bag opening apparatus 10 constructed according to the principles of the present invention includes a frame or plate 12 and a movable carriage 14. The carriage 14 is mounted on a pair of support rods 16 slidably mounted in linear bearings 18. The linear bearings are mounted on the bottom (as illustrated in FIGS. 1–3 ) of the frame 12.

Figure 5A:
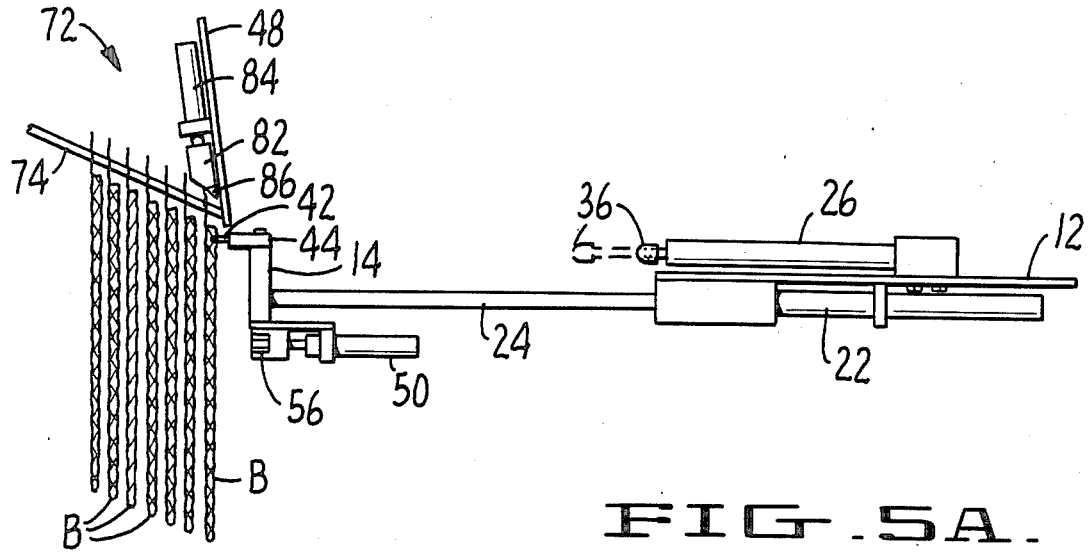
FIGS. 5A–5C illustrate the method of operation of the bag opening apparatus of the present invention.

The carriage moves between a retracted position (as illustrated in FIGS. 1 and 2) and an extended position (as illustrated in FIG. 5A) by a first piston and cylinder assembly 22 (FIG. 2). Rod 24 of the piston and cylinder assembly 22 is secured to the back (to the left in FIG. 2) of the carriage 14 so that the carriage may be extended forward or retracted backward by means of the piston and cylinder assembly. As illustrated, the first piston and cylinder assembly 22 is fixably secured to the bottom of frame 12, although it would be possible to provide for axial adjustment of the assembly so that the extent of travel could be modified. Alternatively, the extent of travel of the rod 24 could be internally adjusted with the piston and cylinder assembly by well-known means.

A second piston and cylinder assembly 26 is mounted in a sliding block 28 on top of frame 12. The sliding block 28 is secured in a slot 30 and frame 12 by a pair of screws 32. In this way, the extent of travel of rod 34 of the piston and cylinder assembly 26 may be adjusted by moving the block 28 axially within the slot 32. A resilient bumper 36 is mounted on the distal end of rod 34 so that it will engage a cavity or receptacle 38 formed in the rear of carriage 14. Although the bumper 36 is not secured to the carriage 14 in any way, the extension of rod 34 forward, as illustrated in broken line in FIG. 5A, will prevent the full rearward retraction of the carriage 14 by the first piston and cylinder assembly 22.

A pair of pins 42 are mounted in collars 44 on top of the carriage 14. Each collar 44, in turn, is mounted on a post 46 which is rotatably mounted in a vertical shaft 48 formed in the body of the carriage. The collars 44 are fixedly mounted on the posts 46 so that rotation of the posts results in pivoting of the collars 46 and pins 42.

A third piston and cylinder assembly 50 is mounted by a bracket 52 on the carriage 14. Rod 54 of the piston and cylinder assembly 50 is connected to a linkage assembly 56 comprising a clevis 58 and a pair of arms 60 and 62. Each arm 60 and 62 is mounted to pivot at the bottom of one of the vertical posts 46.

Figure 6:
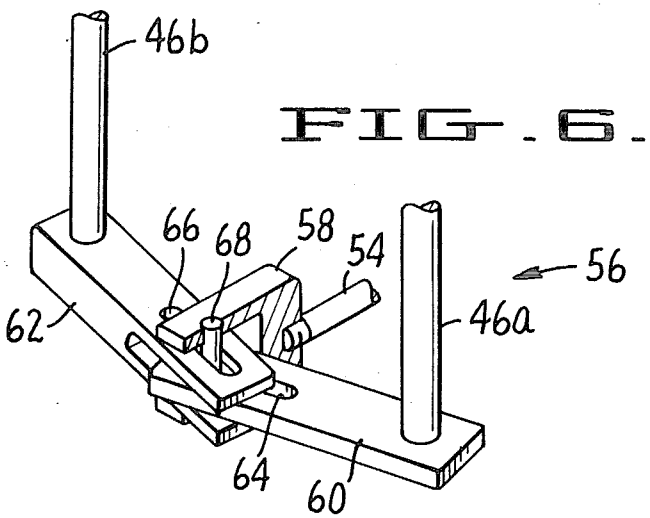
FIG. 6 is a simplified perspective view of the linkage assembly carried by the carriage of the present invention, with portions broken away.

Referring now to FIG. 6, details of the linkage assembly 56 will be described. Each arm 60 and 62 includes a slot (64 and 66, respectively) which receives a pin 68 carried by the clevis 58. Thus, as the rod 54 is moved forward and backward by the piston and cylinder assembly 50, the clevis 58 rotates each of the linkage arms 60 and 62 in the opposite direction around the respective vertical post 46. As the rod 54 is moved forward, post 46*a* carried by arm 60 is rotated in the counter clockwise direction (as viewed in FIG. 1) while the post 46*b* carried by the second linkage arm 62 is rotated in the clockwise direction. Referring also to FIG. 1, it can be seen that the forward movement of rod 54 causes the pins 42 to move apart from each other, while the retraction of rod 54 causes the pins to move toward each other.

Figure 4:
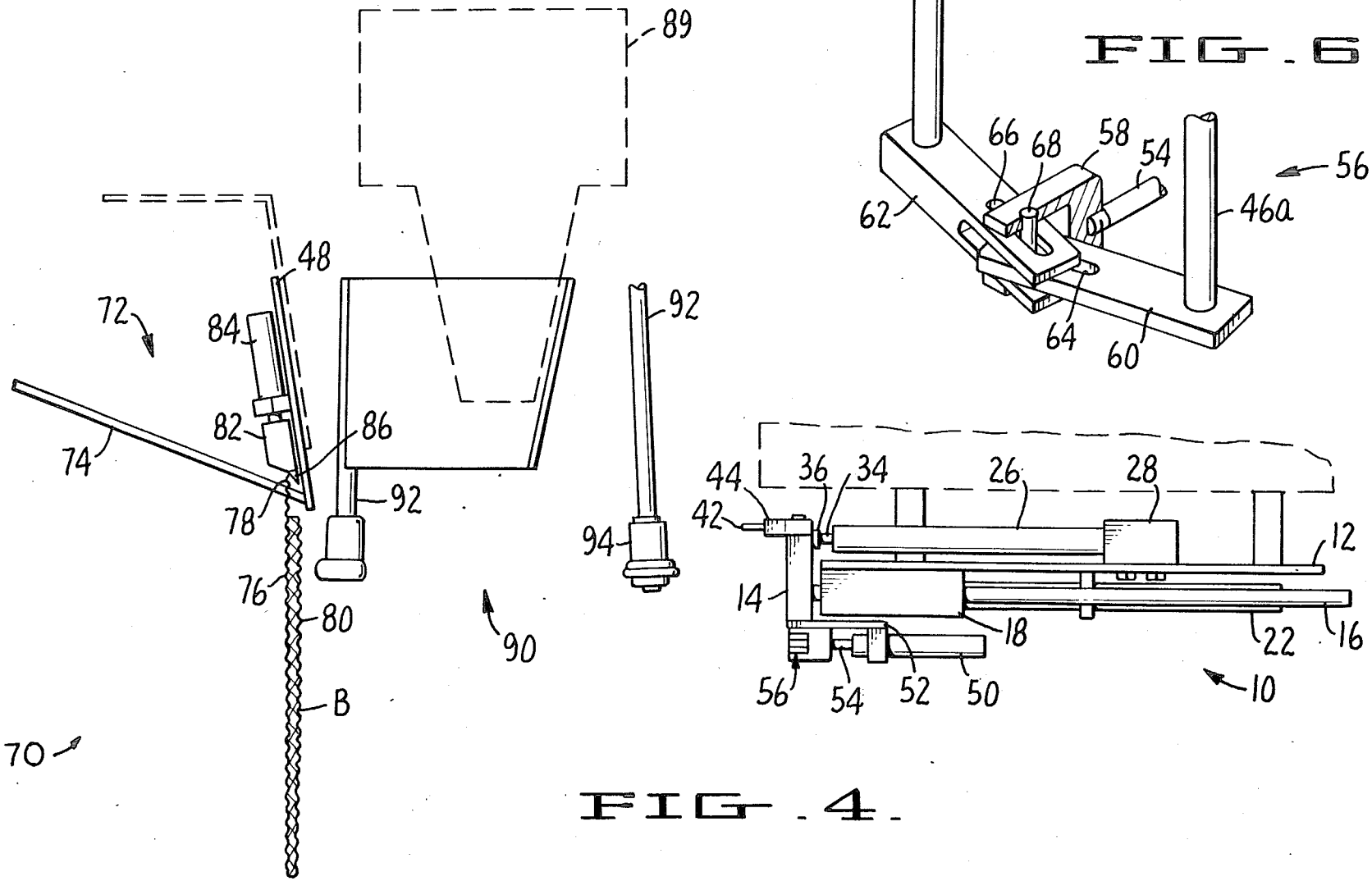
FIG. 4 illustrates the bag opening apparatus of the present invention together with a mechanism for supporting a stack of empty bags and a bag holding and filling apparatus (shown in phantom).

Referring now to FIG. 4, the utilization of the bag opening apparatus 10 of the present invention will be illustrated and described in connection with a conventional automatic bag filling system 70. The bag filling system 70 is illustrated schematically, with only the essential aspects of the equipment being shown. Such bag filling systems, however, are well-known in the art and need not be described in detail herein.

The bag filling system 70 includes a wicket assembly 72 including a pair of wicket pins 74 (only one of which is illustrated in FIG. 4) for receiving the mesh bags thereon. A single mesh bag B is illustrated as hanging vertically from the wicket pins at the forwardmost end (to the right in FIG. 4) of the wicket assembly 72. One face 76 of the bag includes an upper extension 78, which is received on the wicket pins 74, while the opposed face 80 is free from the wicket pins 74. In this way, the opposed face 80 may be drawn away from the suspended face 76 by the bag opening apparatus 10, as will be described in detail hereinafter.

The wicket pins 74 are mounted on wicket brackets 48 which are spaced apart and adjustable so that the wicket pins 74 may be adjusted to accomodate the wickets of premade bags.

The wicket assembly 72 further includes a knife block 82 reciprocatably mounted on a knife cylinder 84. The knife block 82 carries a knife blade 86 which is located to sever the extension 78 of the Bag to release the bag from the wicket assembly 72.

The bag filling system 70 also includes a bag suspension assembly 90 which supports and holds open the bag during the filling operation. The suspension assembly 90 includes four hanging fingers 92 (only two of which are illustrated) which are inserted into the open bag while it is held open by the bag opening apparatus 10. The four fingers 92 are initially collapsed so that they may enter the bag B without interference, and thereafter expanded to open the periphery of the open end of the bag to its full extent. After the bag B has been hung, the knife cylinder 84 is actuated to reciprocate knife blade 86 and sever the wicket extension 78 of the bag. At least some of the hanging fingers 92 include detection heads 94 which are capable of sensing when the bag B is firmly secured by the suspension assembly 90. Conveniently, the detection head may work by bleeding a small air stream which is shut off as pressure is exerted laterally on the detection head 94. This results in a pressure increase which may be detected automatically. Failure to detect pressure increase will prevent product from being inserted into the bag and may also trip an alarm or the like.

Figure 5B:
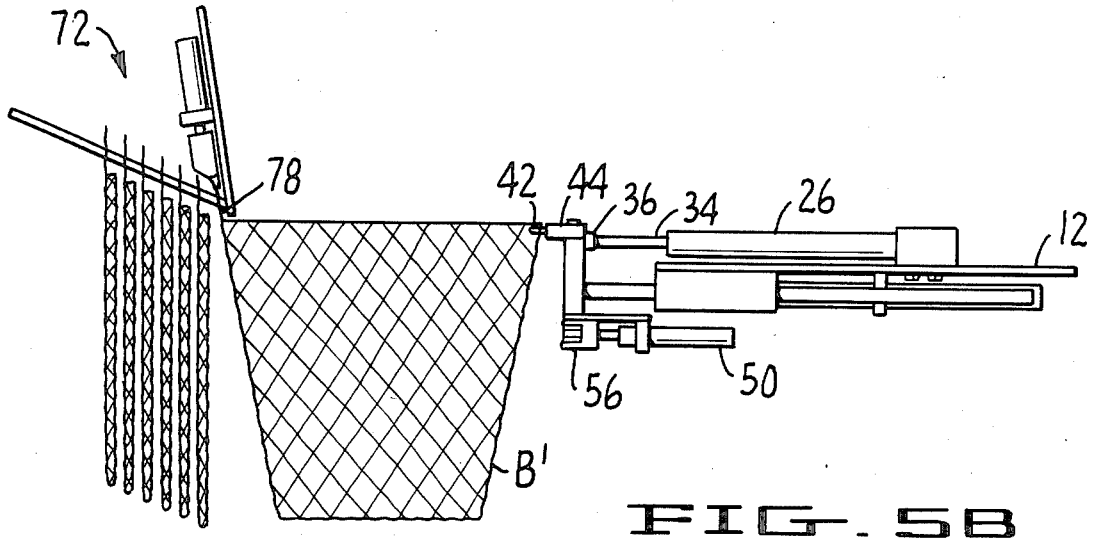
Figure 5C:
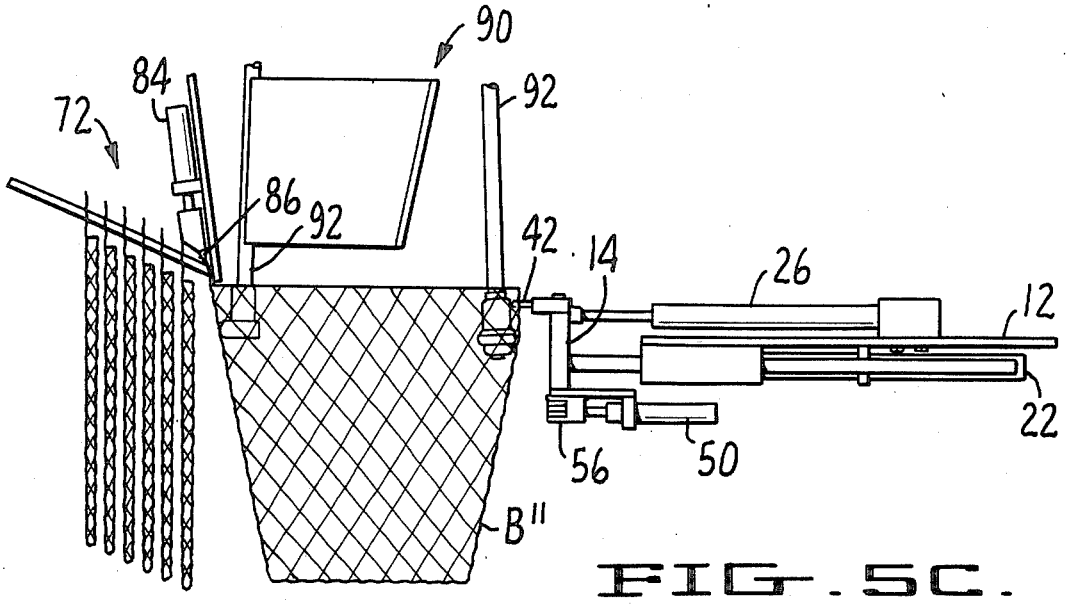

Referring now to FIGS. 5A–5C, the operation of the bag filling assembly 70 and the bag opening apparatus 10 of the present invention will be described. As illustrated in FIG. 5A, the bag opening operation begins by extension of the first piston and cylinder assembly 22 so that pins 42 penetrate at least the first Bag. As they penetrate, the pins 42 are held parallel to each other by the linkage assembly 56. As the first piston assembly 22 is extended, the second piston and cylinder assembly 26 is also extended so that the bumper 36 is in its extended position as shown in broken line in FIG. 5A.

After the pins 42 have penetrated the bags B, the pins 42 are pivoted away from each other, as illustrated in FIG. 6. The first piston and cylinder assembly 22 is then retracted, and the pins 42 will draw the opposed face 80 of the first bag B on the wicket to the right as illustrated in FIGS. 5A–5C. As the face is drawn to the right, the bag will open as illustrated at B′ in FIG. 5B. The extent of the opening is controlled by the position of the bumper 36 which stops the travel of carriage 14 at a desired location. As illustrated in FIG. 5B, the bag B′ is supported on one side by the wicket extension 78 on the bag and on the other face by the pins 42 of the bag opening assembly 10.

Once the bag B has been opened, the hanging fingers 92 of the bag suspension assembly 90 are lowered into the bag and expanded outward to secure the bag B′ about its peripheral opening. Once the bag B′ is firmly suspended by the suspension asemmbly 90, the wicket 78 is severed by knife blade 86 and the stop bumper 36 of the second piston and cylinder assembly 26 is retracted. The pins 42 are then returned to their parallel position, and the carriage 14 is retracted. The bag filling operation is accomplished simultaneously with the retraction of the bag opening apparatus 10, and once completed, the bag filling cycle is ready to be repeated.

Although the foregoing invention has been described in some detail by way of illustration and example for purposes of clarity of understanding, it will be obvious that certain changes and modifications may be practiced within the scope of the appended claims.

What is claimed is:

1. An apparatus for opening mesh bags, said apparatus comprising:

a frame;

means located in a fixed position relative to the frame for vertically suspending a plurality of said mesh bags;

a first piston and cylinder assembly mounted on said frame, said piston and cylinder assembly including a piston rod capable of horizontally reciprocating between an extended position proximate to the means for suspending and a retracted position remote from the means for suspending;

a carriage mounted on the piston rod of the first piston and cylinder assembly;

a pair of substantially horizontal spaced-apart pins pivotally mounted on said carriage;

means for pivoting said pins toward and away from each other; and means for selectively stopping the travel of the carriage on the piston rod of the first piston and cylinder assembly at a location intermediate the extended and retracted positions, whereby the pins may be inserted into the mesh bag by extending the piston rod, one face of the mesh bag secured by pivoting the pins, and the bag opened by retracting the piston rod to the intermediate position.

2. An apparatus as in claim 1, wherein the means for stopping the travel of the piston rod is a second piston and cylinder assembly having a piston rod capable of reciprocating in the axial direction, said piston rod positioned to engage the carriage at said intermediate position when fully extended.

3. An apparatus as in claim 1, wherein the means for pivoting said pins comprises a third piston and cylinder assembly having a piston rod, a linkage assembly attached at its middle to the piston rod of the third piston and cylinder assembly, and a pair of posts coupling the pins to the linkage so that actuation of the third piston and cylinder assembly causes the linkage to rotate the posts and pivot the pins.

4. An apparatus as in claim 1, further comprising a pair of linear bearings on the frame, wherein said carriage is mounted on a pair of rods which are slidably received in said linear bearings.

5. An apparatus for opening mesh bags, said apparatus comprising:

a frame;

means located in a fixed position relative to the frame for vertically suspending a plurality of said mesh bags;

a first piston and cylinder assembly mounted on said frame, said piston and cylinder assembly including a piston rod capable of horizontally reciprocating between an extended position proximate to the means for suspending and a retracted position remote from the means for suspending;

a carriage mounted on the piston rod of the first piston and cylinder assembly;

a pair of spaced-apart pins pivotally mounted on said carriage;

means for pivoting said pins toward and away from each other; and a second piston and cylinder assembly having a piston rod capable of reciprocating in the horizontal direction to selectively stop the travel of the carriage on the piston rod of the first piston and cylinder assembly at a location intermediate the extended and retracted positions, whereby the pins may be inserted into the mesh bag by extending the piston rod, one face of the mesh bag secured by pivoting the pins, and the bag opened by retracting the piston rod to the intermediate position.

6. An apparatus for opening mesh bags, said apparatus comprising:

a frame;

means located in a fixed position relative to the frame for vertically suspending a plurality of said mesh bags;

a first piston and cylinder assembly mounted on said frame, said piston and cylinder assembly including a piston rod capable of horizontally reciprocating between an extended position proximate to the means for suspending and a retracted position remote from the means for suspending;

a carriage mounted on the piston rod of the first piston and cylinder assembly;

a pair of spaced-apart pins pivotally mounted on said carriage;

means for pivoting said pins toward and away from each other, said means for pivoting including a third piston and cylinder assembly having a piston rod, a linkage assembly attached at its middle to the piston rod of the third piston and cylinder assembly, and a pair of posts coupling the pins to the linkage so that actuation of the third piston and cylinder assembly causes the linkage to rotate the posts and pivot the pins; and means for selectively stopping the travel of the carriage on the piston rod of the first piston and cylinder assembly at a location intermediate the extended and retracted positions, whereby the pins may be inserted into the mesh bag by extending the piston rod, one face of the mesh bag secured by pivoting the pins, and the bag opened by retracting the piston rod to the intermediate position.

7. An apparatus for opening mesh bags, said apparatus comprising:

a frame including a pair of linear bearings;

means located in a fixed position relative to the frame for vertically suspending a plurality of said mesh bags;

a first piston and cylinder assembly mounted on said frame, said piston and cylinder assembly including a piston rod capable of horizontally reciprocating between an extended position proximate to the means for suspending and a retracted position remote from the means for suspending;

a carriage attached to the piston rod of the first piston and cylinder assembly, said carriage being mounted on a pair of rods which are slidably received in the linear bearings on the frame;

a pair of spaced-apart pins pivotally mounted on said carriage;

means for pivoting said pins toward and away from each other; and means for selectively stopping the travel of the carriage on the piston rod of the first piston and cylinder assembly at a location intermediate the extended and retracted positions, whereby the pins may be inserted into the mesh bag by extending the piston rod, one face of the mesh bag secured by pivoting the pins, and the bag opened by retracting the piston rod to the intermediate position.

8. A system for filling mesh bags having a pair of opposed faces, said system comprising:

means for vertically suspending a plurality of mesh bags from a first of said opposed faces;

an opener for drawing open the other of the opposed faces while the first face remains suspended on said means for vertically suspending, said opener comprising:

(a) a first piston and cylinder assembly having a piston rod capable of horizontally-reciprocating between an extended position proximate to the means for vertically suspending and a retracted position remote from the means for suspending;

(b) a carriage mounted on the piston rod of the first piston and cylinder assembly;

(c) a pair of spaced-apart pins pivotally mounted on said carriage, said pins being disposed generally in a horizontal plane;

(d) means for pivoting said pins toward and away from each other;

(e) means for selectively stopping the travel of the carriage on the piston rod of the first piston and cylinder assembly at a location intermediate the extended and retracted positions whereby the pins may be inserted into the mesh bag by extending the piston rod, one face of the mesh bag may be secured by pivoting the pins, and the bag opened by retracting the piston rod to the intermediate position;

(f) means for suspending the bag after it has been opened by the opener; and (g) means for filling the bag with a product.

9. An apparatus for opening a suspended bag having a pair of mesh faces, said apparatus comprising:

means for vertically suspending the bag;

a carriage;

means for reciprocating the carriage along a substantially horizontal path between an extended position proximate the means for suspending and a retracted position spaced-apart a preselected distance from the means for suspending;

a pair of substantially horizontal spaced-apart pins pivotally mounted on said carriage; and means for pivoting said pins toward and away from each other, whereby said pins will penetrate the bag when said carriage is extended and will engage one face of the bag as the pins are pivoted and the carriage retracted.

10. An apparatus as in claim 9, wherein said means for reciprocating the carriage is a piston and cylinder assembly.

11. An apparatus as in claim 9, further comprising means for selectively stopping the travel of the carriage at a location intermediate the extended and retracted positions so that a bag may be opened by securing one face with the spaced-apart pins and retracting the carriage to said intermediate location.

* * * * *